United States Patent [19]

Wheldon

[11] 4,088,929

[45] May 9, 1978

[54] ELECTRIC CIRCUIT INTERRUPTING DEVICES

[75] Inventor: Robert Joseph Wheldon, Chelmsford, England

[73] Assignee: English Electric Valve Company Limited, Chelmsford, England

[21] Appl. No.: 704,936

[22] Filed: Jul. 13, 1976

[30] Foreign Application Priority Data

| | | |
|---|---|---|
| Jul. 26, 1975 | United Kingdom | 31372/75 |
| Nov. 11, 1975 | Germany | 2550651 |

[51] Int. Cl.[2] ..... H01J 17/14

[52] U.S. Cl. ..... 315/347; 313/156; 313/162; 315/340; 315/344

[58] Field of Search ..... 315/340, 344, 347; 313/156, 161, 162, 195, 204

[56] References Cited

U.S. PATENT DOCUMENTS

| | | | |
|---|---|---|---|
| 3,035,207 | 5/1962 | Beeson et al. | 313/156 X |
| 3,458,758 | 7/1969 | Fraser et al. | 313/204 X |
| 3,519,882 | 7/1970 | Gowar et al. | 315/340 |
| 3,636,407 | 1/1972 | Baker | 315/344 |

*Primary Examiner*—Eugene R. LaRoche

*Attorney, Agent, or Firm*—Diller, Brown, Ramik & Wight

[57] ABSTRACT

A circuit interrupting device for providing protection against surge currents is constructed to operate very rapidly. A surge current generates a magnetic field in coils which deflects an electron beam which normally travels from a cathode to an anode to complete an electric circuit.

12 Claims, 2 Drawing Figures

ELECTRIC CIRCUIT INTERRUPTING DEVICES

Figure 1:
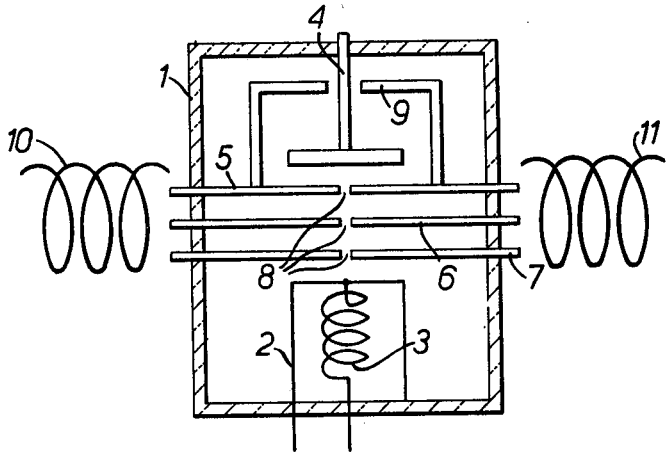

This invention relates to electric circuit interrupting devices and in particular to such devices for use in the protection of circuit elements from surge currents.

Known electric circuit interrupting devices for connection in series with a circuit element to be protected from surge currents operate relatively slowly and are therefore not suitable in applications where rapid operation is required, for example, for the protection of radio frequency oscillating valves in the event of the occurrence of a flash arc in the valve.

One way of overcoming this difficulty is to connect a socalled "crow-bar" device, typically a gas discharge device, in parallel with the device to be protected, which by-passes overload current around the device being protected until an associated interrupting device has had time to operate. However, this method has the disadvantage that the magnitude of the current to be by-passed may be very high, and where there are several devices to be protected operating from a common power supply failure of one device results in all the other devices being by-passed as well.

The present invention seeks to provide an improved electric circuit interrupting device which is capable of operating at a relatively high speed.

According to a feature of the present invention an electric circuit interrupting device comprises an envelope containing a gas or vapour filling, an anode and a cathode housed within the envelope, a plurality of control and/or screen members disposed within the envelope between the anode and cathode and providing two or more apertures through which in operation an electrical discharge can pass from the cathode to the anode, and means for producing a magnetic field in a region of the discharge within and adjacent to said apertures, directed substantially perpendicular to the path of said discharge in that region, the maximum dimension of said apertures in a direction perpendicular to the path of the discharge in said region being sufficiently small so that, in operation of the device and when said discharge is passing, the presence or absence of said magnetic field determines the state of conduction from said cathode to said anode.

Preferably the arrangement is such that the presence of said magnetic field causes said discharge to be quenched.

Whilst primarily intended for connection in series with a circuit element to be protected from surge currents, the device may find other applications.

According to a feature of this invention, a preferred circuit arrangement utilising a device in accordance with the present invention as described above comprises said device and pulse generating means connected to energise said means for producing a magnetic field so as to produce a pulse of magnetic field in said region whenever such discharge is to be interrupted.

Preferably a screen is provided for said anode to reduce the effects of changes in the potential of said anode. Preferably said screen is electrically connected to that one of said plurality of members which is nearest to said anode, but this is not essential. The screen may for example be electrically connected to said cathode.

Preferably three control and/or screening members are provided between said anode and said cathode and preferably in a circuit arrangement the intermediate one of said three members is utilised as a control grid, means being provided for applying a positive going trigger signal to said intermediate member in order to render said device conductive.

Preferably means are provided for applying a negative bias signal to said intermediate member at times when said positive going trigger signal is not applied thereto.

The cross-sectional shape of said small apertures in a direction perpendicular to the path of said discharge is preferably rectangular, but may also be round or oval.

Figure 2:
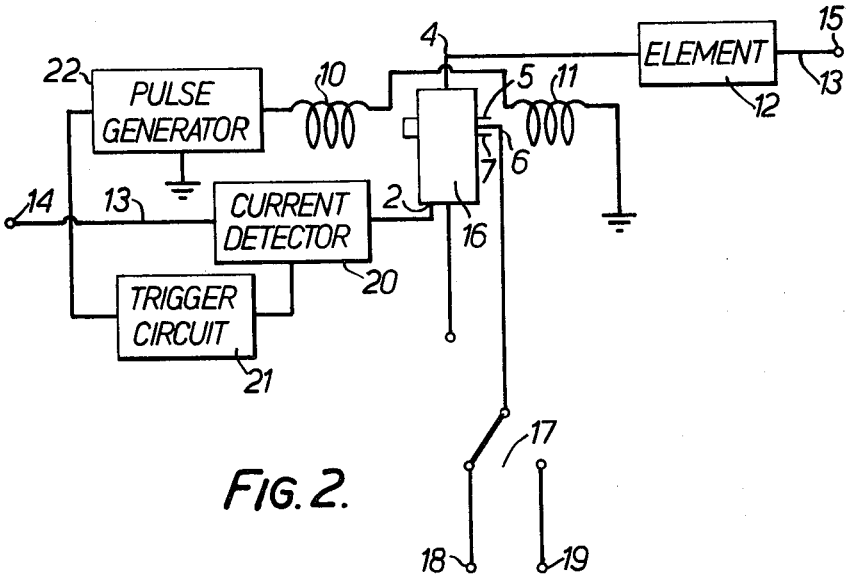

The invention is further described with reference to the accompanying drawing in which, FIG. 1 is a cross-section through one electric circuit interrupting device in accordance with the present invention and FIG. 2 is one example of a circuit arrangement including the device of FIG. 1 and in accordance with the present invention.

Referring to FIG. 1, the device consists of a glass or ceramic envelope 1, which is gas or vapour filled, within which is a cathode 2, with its associated heater 3, and an anode 4. Between cathode 2 and anode 4 are three similarly apertured electrode members 5, 6 and 7. The aperture 8 in each of the members 5, 6 and 7 is of rectangular cross-section in a direction perpendicular to the path of discharge between cathode 2 and anode 4. The apertures 8 form the sole path therebetween for the discharge. In this example the apertures 8 are axially disposed in line with one another.

A screening box 9 is provided to surround the anode 4. The screening box 9 is mounted on and electrically united with electrode member 5. Screening box 9 is provided to screen electrode members 6 and 7 from the effects of changes in potential of the anode 4 so that such changes cannot materially electro-statically affect the potential of these last mentioned two members.

Mounted on opposite sides of the envelope 1 are two coils 10 and 11 which are arranged such that when energised a magnetic field is produced in the region of the discharge path through the apertures 8 which field is directed perpendicular to the path of the discharge through the apertures 8.

In operation means would normally be provided for applying a positive going trigger signal to electrode member 6 in order to initiate the discharge which then passes from the cathode to the anode by way of the three apertures 8. Preferably electrode member 5 is connected to cathode 2 either directly or via an impedance. Electrode member 7 may be used to pre-ionise the space between it and the cathode 2 in known manner.

When it is required to interrupt the discharge a pulse of current is passed through the two coils 10 and 11 from a suitable source in order to generate the aforementioned magnetic field perpendicular to the discharge. This has the effect of causing the discharge to be quenched, the effect being greater as the magnetic field is made stronger and the apertures smaller. It is believed that the effect is one of causing the discharge to be moved laterally, the closer proximity of the electrodes when a discharge is passing through a small aperture enhancing the tendency to quench.

At times when a positive going trigger signal is not applied to electrode 6, normally a negative bias signal is connected thereto.

The device may find a number of different applications one of which is illustrated schematically in FIG. 2.

Referring to FIG. 2, it is assumed that it is required to protect a circuit element 12 from the effects of current surges in the supply path 13 from the element 12, between terminals 14 and 15. The device, here referenced 16, is connected with the discharge path between the cathode 2 and the anode 4 in series in said path 13. Electrode 6 is connected to an electronic two way switch 17 (a trigger pulse transformer in series with a bias supply for example) which, in the position shown, applies a negative bias potential from a source 18 to the electrode 6. In the other position of the switch 17 a positive going trigger signal from a source 19 is applied to electrode 6 to initiate discharge through the device 16 thus permitting current to flow through the path 13 to supply the element 12. Connected in the path 13 is a current detector 20 which is arranged, upon the occurrence of an overload current to energise a trigger circuit 21 which is connected to a pulse generator 22 provided to pass a pulse of current through the windings 10 and 11 so as to cause such discharge to quench.

In another application of the invention a circuit configuration similar to that shown in FIG. 2 is used but in place of current detector 20 a timing circuit is provided which alternately causes switch 17 to apply the positive going trigger signal from source 19 to electrode member 6 and triggers pulse generator 22 to quench the discharge. The alternating initiation of discharge and subsequent quenching causes the supply current to the element 1 to be in the form of pulses of predetermined duration.

I claim:

1. An electric circuit interrupting device comprising an envelope containing a gas or vapour filling, an anode and a cathode housed within the envelope, a plurality of control and/or screen members disposed within the envelope between the anode and cathode and providing two or more apertures through which in operation an electrical discharge can pass from the cathode to the anode, and means for producing a magnetic field in a region of the discharge within and adjacent to said apertures, directed substantially perpendicular to the path of said discharge in that region, the maximum dimension of said apertures in a direction perpendicular to the path of the discharge in said region being sufficiently small so that, in operation of the device and when said discharge is passing, the presence or absence of said magnetic field determines the state of conduction from said cathode to said anode.

2. A device as claimed in claim 1 and wherein the arrangement is such that the presence of said magnetic field causes said discharge to be quenched.

3. A device as claimed in claim 1 and wherein a screen is provided for said anode to reduce the effects of changes in the potential of said anode.

4. A device as claimed in claim 3 and wherein said screen is electrically connected to that one of said plurality of members which is nearest to said anode.

5. A device as claimed in claim 3 and wherein said screen is electrically connected to said cathode.

6. A device as claimed in claim 1 and wherein three control and/or screening members are provided between said anode and said cathode.

7. A device as claimed in claim 1 and wherein the cross-sectional shape of said small apertures in a direction perpendicular to the path of said discharge is rectangular.

8. A circuit arrangement comprising a device as claimed in claim 1 connected in series with a circuit element to be protected from surge currents.

9. A circuit arrangement comprising a device as claimed in claim 1 and comprising pulse generating means connected to energise said means for producing a magnetic field so as to produce a pulse of magnetic field in said region whenever such discharge is to be interrupted.

10. A circuit arrangement comprising a device as claimed in claim 6 and wherein the intermediate one of said three members is utilised as a control grid, means being provided for applying a positive going trigger signal to said intermediate member in order to render said device conductive.

11. A circuit arrangement as claimed in claim 10 and wherein means are provided for applying a negative bias signal to said intermediate member at times when said positive going trigger signal is not applied thereto.

12. In an electric circuit interrupting device of the type including an envelope containing a gas or vapor filling; an anode and a cathode housed within said envelope and disposed in spaced relation; a plurality of spaced control members disposed within said envelope in the space between said anode and said cathode and presenting at least two apertures aligned with each other and between said anode and said cathode whereby an electrical discharge can pass from the cathode to said anode; and means for producing a magnetic field to extinguish such electrical discharge, the improvement wherein said means comprises:

a first coil disposed adjacent one side of said envelope and a second coil disposed adjacent the opposite side of said envelope, the axes of said coils being aligned with each other and with the space between said control members and said coils being connected electrically in series, and means for energizing said coils to produce a magnetic field concentrated along the axes of said coils and passing within said space between said control members perpendicularly to said gas discharge.

* * * * *